US006389863B1

(12) United States Patent
Ziemons et al.

(10) Patent No.: US 6,389,863 B1
(45) Date of Patent: May 21, 2002

(54) RESIDUE STRIPPER FOR METAL-EXTRUSION PRESS

(75) Inventors: Heinrich Ziemons; Franz Schall, both of Dormagen (DE)

(73) Assignee: SMS Eumuco GmbH, Leverkusen (DE)

( * ) Notice: Subject to any disclaimer, the term of this patent is extended or adjusted under 35 U.S.C. 154(b) by 0 days.

(21) Appl. No.: 09/690,863

(22) Filed: Oct. 17, 2000

(30) Foreign Application Priority Data

Oct. 28, 1999 (DE) ..... 199 51 933

(51) Int. Cl.[7] ..... B21C 23/00
(52) U.S. Cl. ..... 72/255; 72/481.8; 72/482.91
(58) Field of Search ..... 72/255, 476, 478, 72/481.8, 482.91, 482.92; 83/582, 584, 585

(56) References Cited

U.S. PATENT DOCUMENTS

| | | | | |
|---|---|---|---|---|
| 3,220,237 A | * 11/1965 | Govan | ..... | 72/255 |
| 4,793,170 A | * 12/1988 | Daniels | ..... | 72/255 |
| 5,237,901 A | * 8/1993 | Warga, III | ..... | 83/582 |
| 5,740,713 A | * 4/1998 | Korb | ..... | 83/582 |

FOREIGN PATENT DOCUMENTS

| | | | | |
|---|---|---|---|---|
| DE | 553 782 | 6/1932 | | |
| JP | 62-234616 | * 10/1987 | ..... | 72/255 |
| JP | 6-533 | * 1/1994 | ..... | 72/255 |
| WO | 882836 | * 7/1953 | ..... | 72/255 |

* cited by examiner

*Primary Examiner*—Ed Tolan
(74) *Attorney, Agent, or Firm*—Herbert Dubno; Andrew Wilford

(57) ABSTRACT

A stripper assembly used in combination with a metal-extrusion press having a die with a back face on which residue is formed during an extrusion operation, has a blade carrier movable generally parallel to the die back face, a blade pivotal on the carrier and having an edge engageable with the die back face, and a biasing element braced between the blade and the carrier for urging the blade edge with a predetermined force transversely against the die back face. The biasing element is a pack of spring washers. The blade has a back stripper face and the carrier has a confronting front stripper face. One of the stripper faces is formed with a pocket open toward the other of the stripper faces and holding the biasing element. The stripper assembly further has a stop bolt threaded into the carrier, extending through the blade, and having a head engageable with a front face of the blade.

8 Claims, 2 Drawing Sheets

RESIDUE STRIPPER FOR METAL-EXTRUSION PRESS

FIELD OF THE INVENTION

The present invention relates to an extrusion press. More particularly this invention concerns a residue stripper for such a press that forms metal into rods or bars.

BACKGROUND OF THE INVENTION

In the direct extrusion of metal profiles, rods, and tubes from brass, aluminum, copper, lead, and the like a billet of the metal is inserted into a tubular guide or container whose front end is pressed against a back face of an extrusion die formed with a passage corresponding to the profile of the piece to be produced. A ram engaged into a rear end of the container forces the metal plastically through the die to produce the desired workpiece which is characterized by an extremely fine grain structure, smooth surface, and accurate shape.

The ram stops when its front end is at a short spacing from the back face of the die, leaving on the rear end of the extrusion a plug of residue. The container is retracted backward to expose this residue which must then be cut off the workpiece so it can be pulled out of the front end of the die.

According to German patent 553,782 the residue is sheared off the trailing end of the workpiece by a blade that is moved transversely across the back face of the die. If there is any misalignment between the residue-stripping blade and the die various problems can result. If the blade is too close it can gouge into and damage the die or get stuck on the die. If it is too far it can leave residue on the back face of the die, making it difficult to set the container flush on the die for the next extrusion operation and also making it difficult to get the workpiece out of the die assembly.

OBJECTS OF THE INVENTION

It is therefore an object of the present invention to provide an improved stripper assembly for a direct-extrusion press.

Another object is the provision of such an improved stripper assembly for a direct-extrusion press which overcomes the above-given disadvantages, that is which ensures clean removal of the residue from the back face of the die without damage to the die or lodging of the cutter on the workpiece.

SUMMARY OF THE INVENTION

According to the invention a stripper assembly used in combination with a metal-extrusion press having a die with a back face on which residue is formed during an extrusion operation, has a blade carrier moveable generally parallel to the die back face, a blade pivotal on the carrier and having an edge engageable with the die back face, and a biasing element braced between the blade and the carrier for urging the blade edge with a predetermined force transversely against the die back face.

Thus with this system the blade can compensate for minor movements of the die, caused for instance by thermal expansion, and will always cleanly remove the residue on its back face. It is possible to set the biasing force such that clean stripping is ensured without damage to the die assembly. If the blade encounters, for example, a hard crystalline deposit on the die back force, it will be able to deflect outward without damage to itself.

According to the invention the biasing element is a pack of spring washers. The blade has a back stripper face and the carrier has a confronting front stripper face. One of the stripper faces is formed with a pocket open toward the other of the stripper faces and holding the biasing element. Such a spring back can readily be set to produce any desired biasing force, even a relatively great one as is normally needed. The die back face can have a bevel on its edge turned toward the stripper assembly so that, when the blade is advanced into contact with the die back face, the blade is cammed back against the spring force.

The stripper assembly further has according to the invention a stop bolt threaded into the carrier, extending through the blade, and having a head engageable with a front face of the blade. Thus the outer position of the blade is defined by the bolt head which acts as a stop or abutment. During normal residue removal a space of about 1.5 mm is present between the bolt head and the blade.

A pusher member can be engaged between the blade and the carrier. Furthermore the pivot defines an axis and the carrier and blade have complementary semicylindrical surfaces centered on the axis and bearing on each other. Thus there is good force transmission via surface contact between the carrier and the blade.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
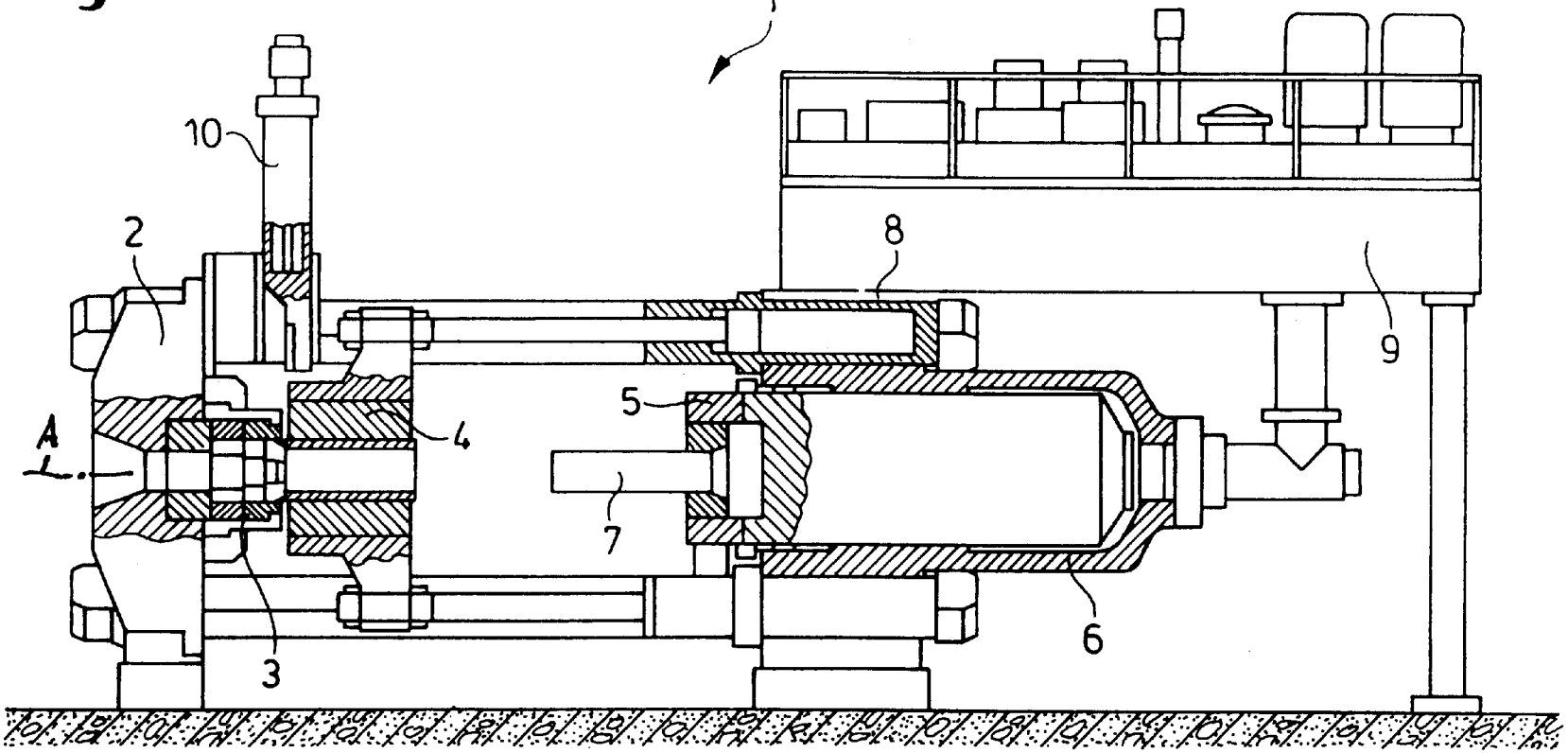
FIG. 1 is a small-scale and partly diagrammatic side view of a direct-extrusion press according to the invention.

As seen in FIG. 1 a direct-type extrusion press 1 has a front platen 2 carrying a die assembly 3 centered on a horizontal axis A and an axially displaceable guide or container 4. A main cylinder 6 can move a cross beam 5 carrying a ram 7 engageable in the cylindrical guide of the container 4 and double-acting hydraulic rams 8 can press the container 4 against a back face 3' (FIG. 2) of the die assembly 3 or withdraw it axially therefrom. A hydraulic control unit 9 including a reservoir operates the cylinders 6 and 8. All this structure is generally standard.

Figure 2:
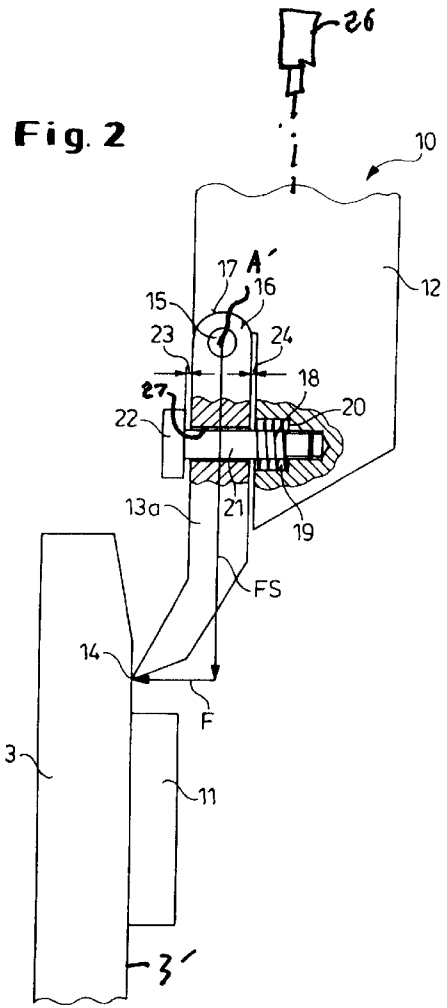
FIG. 2 is a detail view of a stripper assembly in accordance with the invention.

According to the invention as shown in FIG. 2 stripper assembly 10 has a blade carrier 12 movable perpendicular to the axis A with a force FS by an actuator shown schematically at 26 and carries a blade 13*a* having a sharp and forwardly offset inner edge 14 adapted to ride across the back face 3' of the die 3 to shear a residue block 11 from it. This blade 13*a* is mounted on the carrier 12 on a pivot 15 for pivoting about a horizontal axis A'. The carrier 12 has a semicylindrical concave pusher surface 17 centered on the axis A' and the blade 13*a* has complementary convex rear surface 16 riding on the surface 17 and serving for transmitting force between the blade 13*a* and carrier 12 by surface contact.

A bolt 21 extending parallel to the axis A has a shank extending with spacing through a hole 27 in the blade 13*a* and threaded into the support 12 and a head 22 engageable with a front face of the blade 13. A counterbore 19 around the bolt 21 holds a compression spring 18 bearing forward on the blade 13*a* and backward on a floor 20 of the counterbore 19 to urge the blade edge 14 with some force F against the die face 3' when in contact therewith or against the bolt head 22. The spacing of the carrier 12 from the die 3 is such that when the blade edge 14 is bearing on the surface 3' the front face of the blade 13*a* is separated by a small spacing 23 of about 1.5 mm from the bolt head 22 which acts as a stop or abutment and the rear face of the blade 13*a* is separated by a similar small spacing 24 from a front face of the carrier 12.

Thus the blade edge 14 is pressed against the die 3' with sufficient force that it will remain in contact therewith, without gouging it, so as to cleanly shear off the residue 11 as the blade 13*a* is moved downward. Any minor changes in position of the back face 3' are easily compensated for, and the blade 13*a* can deflect backward over any fused-on particles.

Figure 3:
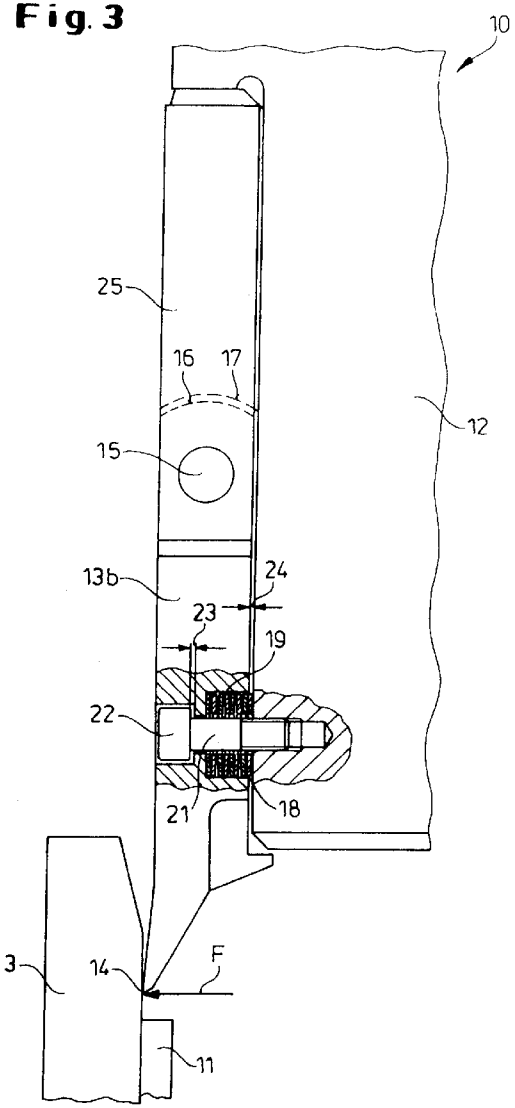
FIG. 3 is a view like FIG. 2 of another stripper assembly according to the invention.

In the arrangement of FIG. 3, where reference numerals from FIG. 2 are used for functionally identical structure, a blade 13*b* has its rear end 16 bearing on a surface 17 of a pusher bar 25 also pivotal about the axis 15 and having its outer end in direct flat contact with the carrier 12. In addition here the counterbore 19 is formed in the blade 13*b* and the springs 18 is a pack of belleville washers. Otherwise this arrangement is substantially identical to that of FIG. 2.

We claim:

1. In combination with a metal-extrusion press having a die with a back face on which residue is formed during an extrusion operation, a stripper assembly comprising:

a blade carrier movable generally parallel to the die back face and having a front stripper face;

a blade pivotal on the carrier, having an edge engageable with the die back face, and having a back stripper face confronting the front stripper face, one of the stripper faces being formed with a pocket open toward the other of the stripper faces; and means including a biasing element in the recess and braced between the blade and the carrier for urging the blade edge with a predetermined force transversely against the die back face.

2. The extrusion-press stripper assembly defined in claim 1, wherein the biasing element is a pack of spring washers.

3. The extrusion-press stripper assembly defined in claim 1, further comprising a stop bolt threaded into the carrier, extending through the blade, and having a head engageable with a front face of the blade.

4. The extrusion-press stripper assembly defined in claim 1, further comprising a pusher member engaged between the blade and the carrier.

5. In combination with a metal-extrusion press having a die with a back face on which residue is formed during an extrusion operation, a stripper assembly comprises:

a blade carrier movable generally parallel to the die back face;

a blade pivotal on the carrier about an axis and having and edge engageable with the die back face, the carrier and blade have complementary semicylindrical surfaces centered on the axis and bearing on each other; and means including a biasing element braced between the blade and the carrier for urging the blade edge with a predetermined force transversely against the die back face.

6. The extrusion-press stripper assembly defined in claim 5, wherein the biasing element is a pack of spring washers.

7. The extrusion-press stripper assembly defined in claim 5, further comprising a stop bolt threaded into the carrier, extending through the blade, and having a head engageable with a front face of the blade.

8. The extrusion-press stripper assembly defined in claim 5 wherein the carrier includes a pusher member engaged between the blade and the carrier and forming the respective semicylindrical surface.

* * * * *